US009765777B2

(12) United States Patent
Rosenkranz et al.

(10) Patent No.: US 9,765,777 B2
(45) Date of Patent: Sep. 19, 2017

(54) PUMP

(71) Applicant: Magna Powertrain Bad Homburg GmbH, Bad Homburg (DE)

(72) Inventors: Kerstin Rosenkranz, Oberursel (DE); Boris Zinke, Kelkheim (DE)

(73) Assignee: Magna Powertrain Bad Homburg GmbH, Bad Homburg (DE)

( * ) Notice: Subject to any disclaimer, the term of this patent is extended or adjusted under 35 U.S.C. 154(b) by 225 days.

(21) Appl. No.: 14/407,217

(22) PCT Filed: May 15, 2013

(86) PCT No.: PCT/DE2013/100178

§ 371 (c)(1),
(2) Date: Dec. 11, 2014

(87) PCT Pub. No.: WO2013/185751

PCT Pub. Date: Dec. 19, 2013

(65) Prior Publication Data

US 2015/0125332 A1 May 7, 2015

(30) Foreign Application Priority Data

Jun. 12, 2012 (DE) ..... 10 2012 105 062

(51) Int. Cl.
*F01C 19/08* (2006.01)
*F03C 2/30* (2006.01)
(Continued)

(52) U.S. Cl.
CPC ..... *F04C 14/06* (2013.01); *F04C 2/356* (2013.01); *F04C 15/0023* (2013.01)

(58) Field of Classification Search
CPC F04C 2270/701; F04C 14/06; F04C 15/0023; F04C 2/356
(Continued)

(56) References Cited

U.S. PATENT DOCUMENTS

2009/0232690 A1 9/2009 Maruo et al.

FOREIGN PATENT DOCUMENTS

CN 1264454 A 8/2000
DE 2512433 A1 9/1976
(Continued)

OTHER PUBLICATIONS

Englished Translation of DE2835816 by Espacenet, Jan. 2, 2015.*
(Continued)

*Primary Examiner* — Deming Wan
(74) *Attorney, Agent, or Firm* — Dickinson Wright PLLC

(57) ABSTRACT

A pump having a stroke ring which has an axial recess, a rotor which is received in the axial recess so as to be rotatable relative to the stroke ring, wherein the rotor has radial recesses in which delivery elements are displaceable received as viewed in a radial direction, a side plate which closes off the axial recess on a first side, a pressure plate which closes off the axial recess on a second side, wherein the pressure plate has at least one opening, wherein a pressure region of the pump is fluidically connected to external surroundings of the pressure plate through the at least one opening, and wherein at least one fluid path is provided from the pressure region of the pup into an under-vane region of the delivery elements, and a cold-start plate which is preloaded against the pressure plate by means of a spring element such that, at least when the pump is at a stand-still, the cold-start plate closes the at least one opening in the pressure plate to the external surroundings of the pressure plate. The pump is characterized in that the spring element is supported on the pressure plate so as to introduce preload forces into the cold-start plate, and in that the spring element is fastened to the pressure plate.

12 Claims, 5 Drawing Sheets

(51) Int. Cl.

| | |
|---|---|
| ***F04C 2/344*** | (2006.01) |
| ***F04C 18/344*** | (2006.01) |
| ***F04C 14/06*** | (2006.01) |
| ***F04C 15/00*** | (2006.01) |
| ***F04C 2/356*** | (2006.01) |

(58) Field of Classification Search
USPC ... 418/131, 132, 133, 26, 24, 134, 135, 259, 418/260, 264, 171, 206.1, 206.6, 82
See application file for complete search history.

(56) References Cited

FOREIGN PATENT DOCUMENTS

| | | | |
|---|---|---|---|
| DE | 2835816 | A1 | 2/1980 |
| DE | 19631846 | A1 | 2/1997 |
| EP | 0758716 | A2 | 2/1997 |
| JP | H1068390 | A | 3/1998 |

OTHER PUBLICATIONS

International Search Report dated Sep. 25, 2013.
Search Report dated Jan. 6, 2016 from corresponding ChinesePatent Application Serial No. 2013800429877.

* cited by examiner

PUMP

CROSS-REFERENCE TO RELATED APPLICATIONS

This application is a U.S. National State of International Application No. PCT/DE2013/100178 filed May 15, 2013 and which claims the benefit of and priority to German Application No. 102012105062.7 filed Jun. 12, 2012. The entire disclosure of each of the above applications is incorporated herein by reference.

FIELD

The invention relates to a pump having a cam ring which has an axial aperture, a rotor which is received in the axial aperture so as to be rotatable relative to the cam ring, wherein the rotor has radial recesses in which delivery elements are displaceably received as viewed in a radial direction, a side plate which closes off the axial aperture on a first side, a pressure plate which closes off the axial aperture on a second side, wherein the pressure plate has at least one opening, wherein a pressure region of the pump is fluidically connected to external surroundings of the pressure plate through the at least one opening, and wherein at least one fluid path is provided from the pressure region of the pump into an under-vane region of the delivery elements, and a cold-start plate which is preloaded against the pressure plate by means of a spring element in such a way that, at least when the pump is stationary, the cold-start plate closes the at least one opening in the pressure plate to the external surroundings of said pressure plate, wherein the spring element is supported on the pressure plate so as to introduce preloading forces into the cold-start plate, and wherein the spring element is secured on the pressure plate.

BACKGROUND

Pumps of the type discussed here are known. A pump of this kind comprises a cam ring, which has an axial aperture, in which a rotor is received so as to be rotatable relative to the cam ring. Said rotor has radial recesses, in which delivery elements, in particular vanes or rollers, are displaceably received as viewed in a radial direction. Along its circumference, the axial aperture has an inner wall having a contour on which the delivery elements run during rotation of the rotor. In this case, the contour is designed in such a way that each delivery element is moved to a greater or lesser extent out of the radial recess in which it is received, depending on its rotational position relative to the cam ring. Delivery cells delimited by adjacent delivery elements and the inner wall are thereby formed, said cells being referred to as vane cells or roller cells, depending on the type of delivery element. The volume of a vane cell of this kind varies periodically with the rotation of the rotor relative to the cam ring. In this way, at least one suction region and at least one pressure region of the pump are defined, wherein the suction region is arranged in a region in which the volume of the delivery cells increases with the revolution of the rotor. The pressure region is arranged in a region in which the volume of the delivery cells decreases with rotation of the rotor. It is possible for the pump to have two pump sections, each of which has a suction region and a pressure region. This is then what is referred to as a double-stroke pump. The pump furthermore comprises a side plate, which closes off the axial aperture on a first side, and a pressure plate, which closes off the axial aperture on a second side. In this arrangement, the side plate and the pressure plate likewise delimit the delivery cells. The pressure plate has at least one opening, through which the at least one pressure region of the pump is fluidically connected to external surroundings of the pressure plate, in particular to a "pressure chamber". Overall, the pump thus delivers a fluid from a suction chamber fluidically connected to the suction region, via the pressure region, into the pressure chamber. The suction chamber is preferably fluidically connected to a storage tank. The pressure chamber is preferably fluidically connected to a consuming unit.

When the pump is stationary, some of the delivery elements enter the associated recesses owing to the gravitational force acting upon them, depending on the arrangement of the elements. They are then no longer resting on a cam ring wall defining the inner contour. When the pump restarts, the corresponding delivery elements are therefore not able to contribute to the delivery of the fluid until they have moved out of their recesses owing to the centrifugal force and/or through fluid pressure assistance. In order to increase the contact force of the delivery elements on the inner wall of the cam ring, a fluid path is provided from the at least one pressure region of the pump to an "under-vane" region of the delivery elements. This region is arranged radially to the inside of the delivery elements and comprises regions of the radial recesses in the rotor which are arranged radially behind the delivery elements, i.e. closer to an axis of rotation of the pump than said elements. Pressurized fluid delivered by the pump is thus passed out of the pressure region into the under-vane region and supports the delivery elements by increasing the contact force acting thereon against the inner wall of the cam ring.

In order to improve the characteristics of the pump during startup, i.e. what are referred to as cold starting characteristics, a cold-start plate is provided, which is preloaded against the pressure plate by means of a spring element in such a way that, at least when the pump is stationary, said cold-start plate closes the at least one opening in the pressure plate to the external surroundings of said pressure plate. There is then no fluid connection from the pressure region to the pressure chamber. All the fluid delivered by the pump during the starting thereof therefore passes from the pressure region, via the fluid path, into the under-vane region, with the result that all the fluid delivered is initially used to move the delivery elements out of the recesses thereof and to press them against the inner wall of the cam ring. Once the pump has thereby been brought to a fully functional state, the delivery pressure in the pressure region rises, thereby pushing the cold-start plate away from the pressure plate against the preloading force of the spring element. The fluid connection between the pressure region and the pressure chamber is thereby opened and the pump delivers fluid from the suction chamber to the pressure chamber.

EP 0 758 716 B1 discloses a pump having a corresponding supply to an under-vane region and a cold-start plate. In this case, the spring element preloading the cold-start plate is supported on a casing of the pump in order to introduce preloading forces into the cold-start plate. In the case of pumps which do not have a casing or in which the spring element cannot be supported on the casing for other reasons, complex designs are required in order to provide support for the spring element. Moreover, the individual elements, such as the cold-start plate, spring element and, if appropriate, supporting elements for the spring element are easily lost during dispatch, transportation or installation of the pump or are not secured reliably on the pump if they are not integrated into the casing in a conventional manner. This is particularly problematic in the case of pumps referred to as cartridge pumps, which themselves have no casing but are designed as pump inserts that are inserted into preprepared installation spaces in gear casings, for example.

It is therefore the underlying object of the invention to provide a pump which does not have the problems mentioned.

SUMMARY

This object is achieved by provided a pump having a cam ring which has an axial aperture, a rotor which is received in the axial aperture so as to be rotatable relative to the cam ring, wherein the rotor has radial recesses in which delivery elements are displaceably received as viewed in a radial direction, a side plate which closes off the axial aperture on a first side, a pressure plate which closes off the axial aperture on a second side, wherein the pressure plate has at least one opening, wherein a pressure region of the pump is fluidically connected to external surroundings of the pressure plate through the at least one opening, and wherein at least one fluid path is provided from the pressure region of the pump into an under-vane region of the delivery elements, and a cold-start plate which is preloaded against the pressure plate by means of a spring element in such a way that, at least when the pump is stationary, the cold-start plate closes the at least one opening in the pressure plate to the external surroundings of the pressure plate, wherein the spring element is supported on the pressure plate so as to introduce preloading forces into the cold-start plate, and wherein the spring element is secured on the pressure plate.

By virtue of the fact that the spring element is supported on the pressure plate so as to introduce preloading forces into the cold-start plate, it is not necessary to provide additional, complex supporting elements. The assembly improving the cold starting of the pump thus comprises just two parts, namely the cold-start plate and the spring element. Since the latter is furthermore secured on the pressure plate, it is itself held reliably on the pump and also holds the cold-start plate, for its part, reliably thereon. This is an effective way of preventing the cold-start plate and/or the spring element from being lost during transportation, dispatch or installation of the pump, even if the pump does not have a casing.

Preference is given to a pump which is characterized in that it is designed as a roller- or vane-type pump. The delivery elements are designed correspondingly as rollers or vanes. In this case, roller or vane cells are formed for delivery of the fluid. Here, the term "under-vane region" is used in general for the region radially to the inside of the delivery elements, irrespective of whether these are designed as rollers or vanes. Thus, the term under-vane region is also used here in connection with a roller-cell pump.

Preference is also given to a pump which is characterized in that it does not have a casing. The advantages mentioned are obtained particularly in this case because the spring element, which is supported on the pressure plate and secured thereon, holds itself and the cold-starting plate reliably on the pump, ensuring that the parts cannot get lost.

Preference is also given to a pump which is characterized in that it is designed as a gear pump, in particular for installation in a gear casing. The pump, which itself does not have a casing, is thus inserted into the gear casing and held securely there. In this case, it preferably serves to deliver a coolant/lubricant and/or to fill a pressure reservoir for the gear. As a very particular preference, the pump is designed as a "cartridge pump", i.e. as a pump insert which is inserted into a preprepared installation space in a gear casing.

Preference is given to a pump which is characterized in that the spring element is designed as a profiled spring. In this case, it has a shape which, on the one hand, enables it to be supported on the pressure plate while simultaneously introducing preloading forces into the cold-start plate and, on the other hand, enables it to be secured on the pressure plate. In another illustrative embodiment, it is possible for the spring element to be designed as a helical spring, spiral spring, diaphragm spring, leaf spring, corrugated spring or in some other suitable way.

Preference is also given to a pump which is characterized in that the profiled spring has an outer ring, from which at least one spring tongue extends in the direction of the cold-start plate, wherein at least two holding elements for securing the profiled spring on the pressure plate are provided on the outer ring. Here, the at least one spring tongue serves to introduce preloading forces into the cold-start plate, with which it is in operative connection, preferably in mechanical contact. The at least two holding elements are used to secure the profiled spring on the pressure plate and, at the same time, to support said spring, enabling it to introduce preloading forces into the cold-start plate. In one illustrative embodiment, it is possible to provide more than one spring tongue. In particular, two spring tongues are provided in one illustrative embodiment. In another illustrative embodiment, four spring tongues are provided. It is furthermore possible to provide more than two holding elements. In one illustrative embodiment, six holding elements are provided. Any other desired number of spring tongues and/or holding elements is possible.

Preference is also given to a pump which is characterized in that the holding elements are designed as bayonet collars. In this arrangement, they engage in corresponding undercuts formed in the pressure plate. According to the widely known operating principle of a bayonet joint, it is possible to insert the profiled spring into the pressure plate with the holding elements in a first rotational position and to fix it on said plate by pivoting into a second rotational position. Conversely, it is possible to release the profiled spring from the pressure plate again by pivoting out of the second rotational position into the first.

Alternatively or in addition, provision is made for the holding elements to be designed as axial projections, which engage in corresponding axial recesses in the pressure plate. In this case, the projections are preferably radially preloaded and in this way hold the profiled spring on the pressure plate.

Finally, preference is given to a pump which is characterized in that the holding elements designed as axial projections comprise clamping protrusions. Here, the term "clamping protrusions" should be taken to mean radial projections which either engage in corresponding radial recesses in the pressure plate in order to enhance retention of the profiled spring thereon or increase the friction of the axial projections in the corresponding recesses in the pressure plate.

DRAWINGS

The invention is explained in greater detail below with reference to the drawing, in which.

DETAILED DESCRIPTION

Figure 1:
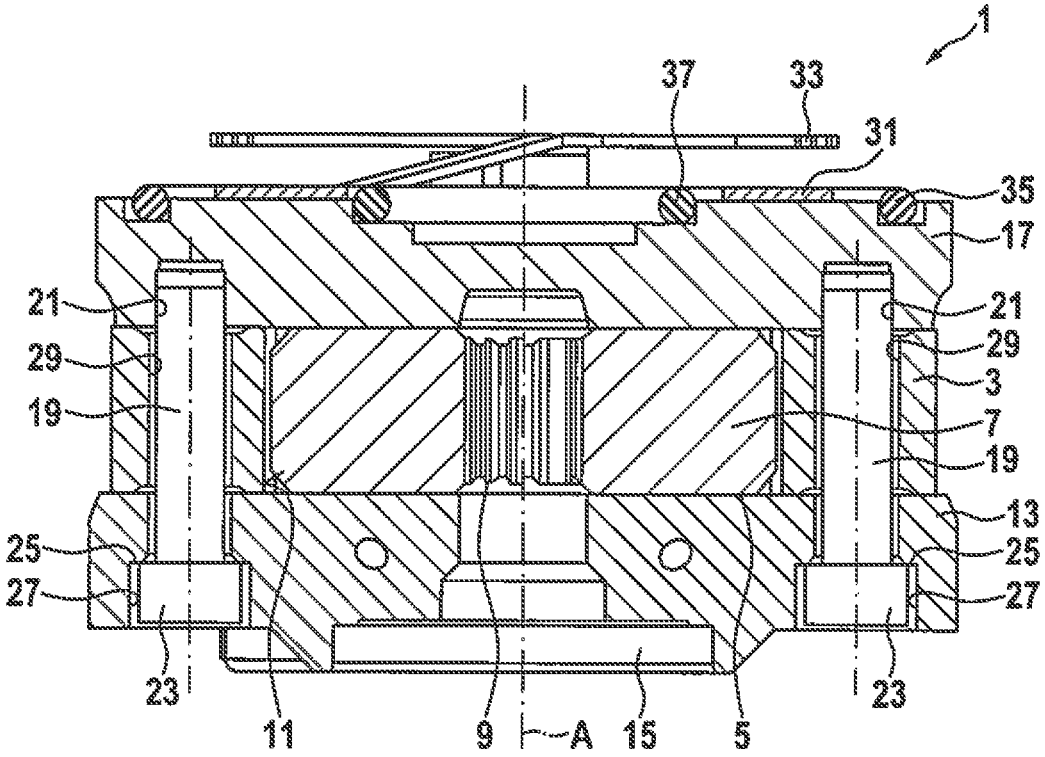
FIG. 1 shows a sectional view of one illustrative embodiment of a pump.

FIG. 1 shows a sectional illustration of one illustrative embodiment of a pump 1. This comprises a cam ring 3, which receives a rotor 7 in an axial aperture 5 in such a way that it is rotatable.

The rotor 7 has radial recesses (not shown here), in which delivery elements (likewise not shown) are displaceably received as viewed in a radial direction.

The rotor 7 is supported so as to be rotatable about an axis of rotation A and comprises an aperture 9 having internal toothing, by means of which it can be coupled to a shaft which provides the rotary drive.

Here, the mention of an axial direction refers to a direction which is oriented parallel to the axis A. A radial direction is a direction which is oriented perpendicularly to the axis A.

The delivery elements (not shown) run on an inner wall 11 of the aperture 5, which has a contour that ensures the formation of delivery cells with a periodically variable volume during rotation of the rotor 7. On a first side, the aperture 5 is closed by a side plate 13. This side plate has an opening 15, through which a shaft (not shown) can be introduced into the pump 1 and brought into engagement with the rotor 7. The shaft preferably has, at least in one or more regions, external toothing, which comes into engagement with the internal toothing of the aperture 9, allowing a torque to be introduced from the shaft into the rotor 7 in a particularly effective manner.

On a second side, the aperture 5 is closed by a pressure plate 17. This has at least one opening (not shown here), through which a pressure region of the pump 1 is fluidically connected to external surroundings of the pressure plate 17. The pump 1 shown is preferably of double-stroke design, i.e. has two pumps sections which each comprise a suction region and a pressure region. In this case, the suction regions and pressure regions are arranged offset relative to one another as seen in the circumferential direction around the axis A. Typically, the two suction regions and the two pressure regions lie opposite one another. For example, the two suction regions are arranged approximately at the 12 o'clock and 6 o'clock positions, and the two pressure regions are arranged at the 3 o'clock and 9 o'clock positions. In the case of a single-stroke pump, the suction region and the pressure region typically lie opposite one another.

The cam ring 3, the side plate 13 and the pressure plate 17 are connected to one another and preloaded against one another by pressure pins 19. In this arrangement, the pressure pins 19 are preferably pressed into recesses 21 in the pressure plate 17 and have a head 23, which rests against a shoulder 25 of a counterbore 27 in the side plate 13. At the same time, the pressure pins 19 pass through holes 29 in the cam ring 3. Overall, the cam ring 3 is thus clamped between the side plate 13 and the pressure plate 17. Two pressure pins 19 are preferably provided.

A fluid path (not shown in FIG. 1) leads from at least one pressure region of the pump 1 into at least one first under-vane region. The pressurized fluid delivered by the pump 1 pushes the delivery elements against the inner wall 11 there and thus supports the action of the pump 1.

A cold-start plate 31 is provided and is preloaded in such a way against the pressure plate 17 by means of a spring element designed as a profiled spring 33 that it closes the at least one opening in the pressure plate 17, at least when the pump 1 is stationary. In particular, the preload predetermined by the spring element is chosen in such a way that the opening remains closed up to a certain limiting pressure. If the delivery pressure of the pump in the pressure region increases beyond the limiting pressure, the cold-start plate 31 is raised from the pressure plate 17 and the opening is exposed. The pump then delivers fluid from a suction chamber (not shown here) into a pressure chamber provided outside the pressure plate 17.

The pump 1 shown in FIG. 1 is designed as a cartridge pump for installation in a gear casing, for example. It therefore does not have its own pump casing but is inserted into a preprepared installation space in the casing, e.g. the gear casing, and is coupled there to a shaft. The casing is then closed, preferably by means of a casing cover, which holds the pump 1 in the installed position thereof. Here, the cover (not shown in FIG. 1) of the casing interacts with a first O-ring 35 in such a way that a pressure chamber sealed off relative to the suction chamber is formed.

In the illustrative embodiment shown, the pump 1 has a second O-ring 37, which preferably interacts in such a way with a projection on the cover of the gear casing that—as seen in a radial direction—there is formed within the first pressure chamber a second pressure chamber sealed off relative to the first pressure chamber. In this case, the cold-start plate 31 is provided only in the region of the first pressure chamber.

The second pressure chamber is fluidically connected to at least one second under-vane region, which—as seen in a circumferential direction—is arranged offset relative to the at least one first under-vane region fluidically connected to the pressure region of the pump. Typically, the first under-vane region is arranged in the region of a suction region, although offset radially inward, i.e. toward the axis A. Pressurized fluid is carried out of the pressure region of the pump, via the fluid path, into the first under-vane region, where it pushes the delivery elements in the suction region of the pump against the inner wall 11. As the rotor rotates, the delivery elements move from the suction region into a pressure region. At the position thereof—as seen in a circumferential direction—a second under-vane region is provided, being offset radially inward, said region being fluidically connected not to the pressure region but to the second pressure chamber. Accordingly, the pump 1 makes available two pressure levels: the pressure level present in the pressure region is, on the one hand, also present in the first pressure chamber and is transmitted into the first under-vane region via the fluid path. As the rotor rotates, the delivery elements move into the pressure region and there enter further into the recesses assigned to them—as seen in a radial direction. In the process, they increase the pressure of the fluid in the recesses, with the result that, in the second under-vane region, said fluid is driven out at a higher pressure, i.e. at a second pressure level, into the second pressure chamber. Of course, two first under-vane regions are provided in the case of a double-stroke pump, said regions being arranged at the level of the suction regions—as seen in a circumferential direction. Two second under-vane regions are likewise provided, said regions being arranged at the level of the pressure regions—likewise as seen in a circumferential direction. At least one of the pressure regions is connected via at least one fluid path to the first under-vane regions, while the second under-vane regions are not fluidically connected to the pressure regions or to the first under-vane regions. On the contrary, they are fluidically connected to the second pressure chamber radially to the inside of the second O-ring 37, with the result that the fluid present in the second under-vane regions can be driven out at an increased pressure into said chamber by the radially entering delivery elements.

Figure 2A:
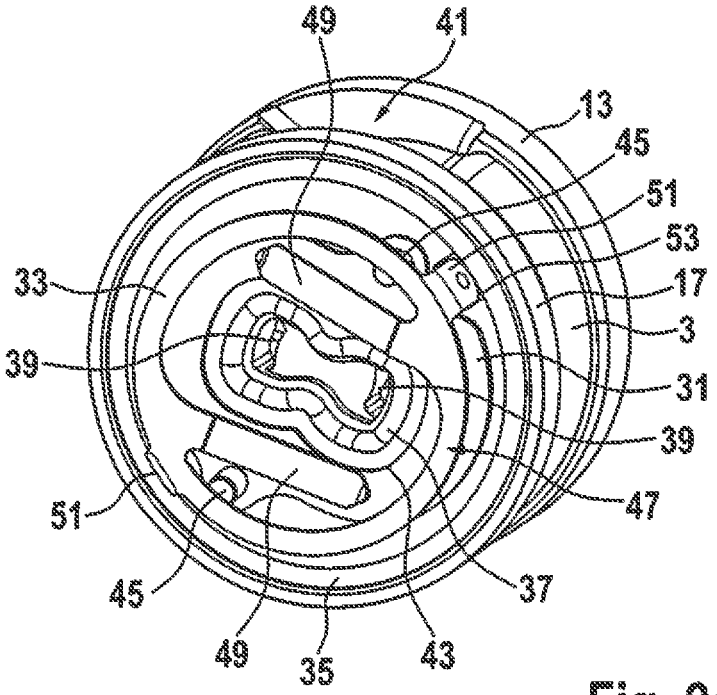
FIG. 2A shows an isometric illustration of the pump according to FIG. 1.

FIG. 2A shows an isometric illustration of the pump 1 according to FIG. 1. Elements that are the same and those that have the same function are provided with the same reference signs, and therefore to this extent attention is drawn to the preceding statements. In this illustration, the second O-ring 37 is particularly clearly visible, and it also shows openings in the pressure plate 17, through which the second pressure chamber is fluidically connected to second under-vane regions 39. Also shown is the opening 41 of a suction chamber, which is preferably fluidically connected to a storage tank for a fluid.

It is likewise possible to see in FIG. 2A that the cold-start plate 31 closes only the opening (not shown) in the pressure plate 17, said opening leading to the first pressure chamber, when the pump 1 is stationary, while the second pressure chamber radially to the inside of the second O-ring 37 is not covered thereby. For this purpose, the cold-start plate 31 has a corresponding hole 43.

Two guide pins 45 are provided, which guide the cold-start plate 31 when the latter rises from the pressure plate 17. In another illustrative embodiment, it is possible to provide more than two guide pins 45. These are received in recesses in the pressure plate 17.

In the illustrative embodiment shown here, the profiled spring 33 has an outer ring 47. Here, two spring tongues 49 extend from said ring in the direction of the cold-start plate 31. Said tongues are in operative connection with the cold-start plate 31, preferably touch it and push it against the pressure plate 17.

Two axial projections 51 are furthermore provided as holding elements on the ring 47 and engage in corresponding, preferably pre-molded, axial recesses in the pressure plate 17, of which only one recess 53 is shown here. The axial projections 51 are preferably radially preloaded. This means that—as seen in the radial direction—they are arranged pivoted inward slightly, in comparison with the assembly position thereof, when the profiled spring 33 is not secured on the pressure plate 17. To secure it on said pressure plate, the projections 51 are therefore pivoted out slightly in a radial direction and, in the installed state, push against walls of the recesses 53. The profiled spring 33 is thereby held securely on the pressure plate 17.

Figure 2B:
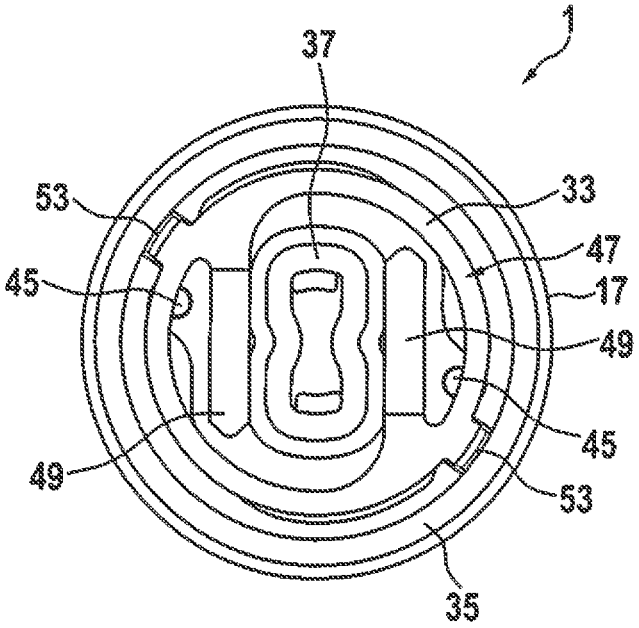
FIG. 2B shows an illustration of the pump according to FIG. 1 in plan view.

FIG. 2B shows a plan view of the illustrative embodiment of the pump 1 according to FIG. 1. Elements that are the same and those that have the same function are provided with the same reference signs, and therefore attention is drawn to the preceding statements. In FIG. 2B, it can be seen that the outer ring 47 also acts as a stop for the guide pins 45. It is therefore not possible for said pins to fall out of their recesses in the pressure plate 17 when the profiled spring 33 is reliably secured on the pressure plate 17. The axial recesses 53, into which the axial projections 51 (not shown here) engage, are likewise shown.

Figure 2C:
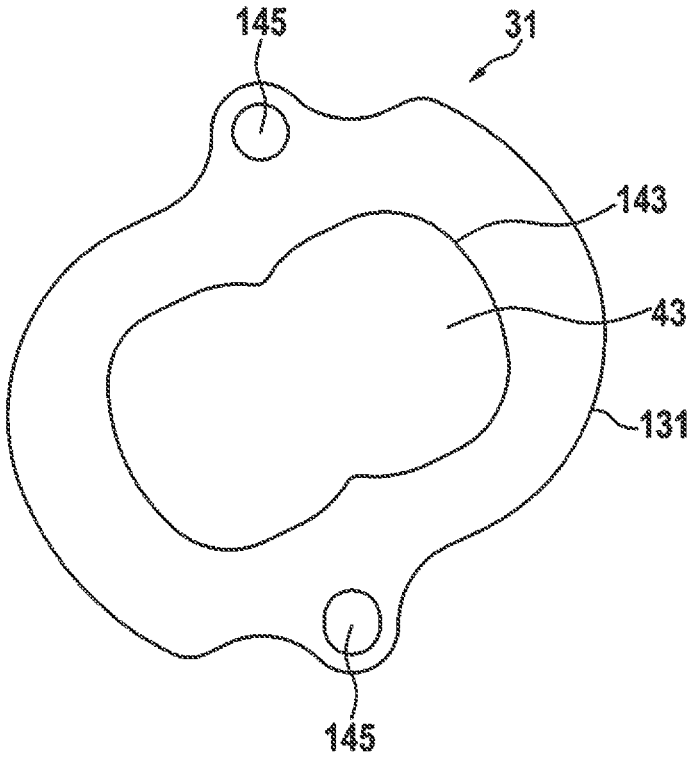
FIG. 2C shows an illustration of the cold-start plate of the pump according to FIG. 1 in plan view.

FIG. 2C shows an illustration of the cold-start plate 31 of the illustrative embodiment of the pump according to FIG. 1 in plan view. Elements that are the same and those that have the same function are provided with the same reference signs, and therefore to this extent attention is drawn to the preceding statements. The cold-start plate 31 comprises a main body 131, which is substantially flat and level, i.e. is of plate-shaped design and has a shape which enables it to be arranged easily on the pressure plate 17 in such a way that it closes the at least one opening in the pressure plate 17 with respect to the external surroundings thereof, at least when the pump is stationary. It then blocks a fluid connection from the pressure region to the first pressure chamber. The main body 131 has the hole 43, which here is provided centrally in the cold-start plate 31 and corresponds in its contour to the contour of the second O-ring 37, which is of substantially 8-shaped design. At the same time, the hole 43 is of somewhat larger design than the second O-ring 37, with the result that at all points—as seen along its circumference—an edge 143 of the hole 43 is arranged radially somewhat to the outside of an outer edge of the second O-ring 37 in the installed state of the cold-start plate 31. Because of the hole 43, the cold-start plate 31 does not block the fluid connection between the second under-vane regions 39 and the second pressure chamber in any of its functional positions. On the contrary, this fluid connection is exposed by the hole 43 in every operating state of the pump 1, especially when the main body 131 is blocking the at least one opening in the pressure plate 17 with respect to the first pressure chamber.

FIG. 2C furthermore shows two holes 145 in the cold-start plate 31, through which the guide pins 45 reach in the installed state in order to guide the cold-start plate 31 when the latter rises from the pressure plate 17. In another illustrative embodiment, it is possible for the cold-start plate 31 to have more than two holes 145, through which correspondingly more than two guide pins 45 can then reach. It is furthermore clear from FIG. 2C that at least one, preferably exactly one, of the holes 145 is designed as a slotted hole in order to allow adjustment of a position of the cold-start plate 31 on the pump 1 or on the pressure plate 17.

Figure 3:
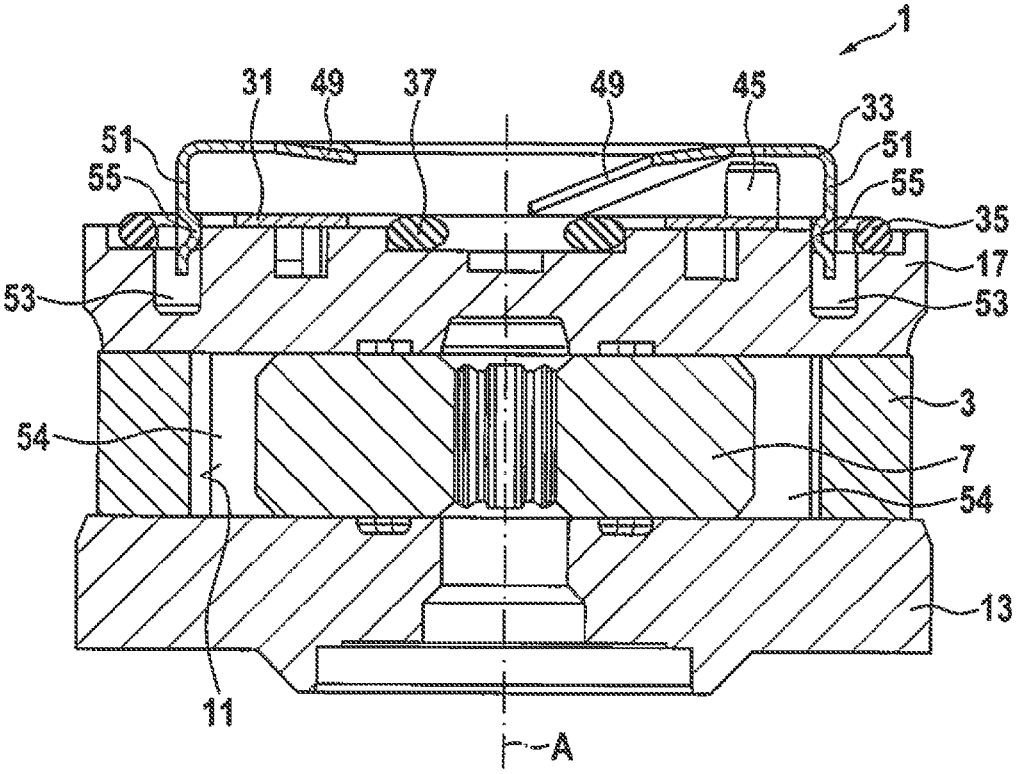
FIG. 3 shows another sectional illustration of the illustrative embodiment of the pump according to FIG. 1.

FIG. 3 shows another sectional view of the illustrative embodiment according to FIG. 1. Elements that are the same and those that have the same function are provided with the same reference signs, and therefore to this extent attention is drawn to the preceding description. In FIG. 3, delivery elements 54 received in radial recesses in the rotor 7 are shown, said delivery elements running along the inner wall 11 of the cam ring 3 and being moved to a greater or lesser extent out of the radial recesses, depending on the rotational position of the rotor 7.

FIG. 3 likewise shows the recesses 53 in which the projections 51 engage. In another illustrative embodiment, it is possible to replace the recesses 53 assigned to the projections 51 by a single recess in the form of a circular groove in which the projections 51 engage. It is also possible to provide more than two projections 51. It is furthermore possible to provide more than two recesses 53 if more than two projections 51 are provided.

In the illustrative embodiment shown, the axial projections 51 comprise "clamping protrusions" 55, i.e. radial projections, in particular projections which protrude radially inward, i.e. toward the axis A, which increase the holding forces of the profiled spring 33 on the pressure plate 17. In the illustrative embodiment shown, the clamping protrusions 55 rest on inner walls of the recesses 53. However, it is possible, in the recesses 53, to provide radial recesses in which the clamping protrusions 55 engage. This further enhances reliable retention of the profiled spring 33 on the pressure plate 17.

In principle, it is also possible to secure the profiled spring 33 on the pressure plate 17 by adhesive bonding, soldering, welding or caulking or in some other suitable way. The essential point is that the profiled spring 33 is supported on the pressure plate 17, ensuring that preloading forces can be introduced into the cold-start plate 31 via the spring tongue 49 and, in particular, that it is secured in a captive manner on the pressure plate 17, simultaneously securing the cold-start plate 31 and also the guide pins 45 against loss.

When the pump 1 is installed in a gear casing, for example, it is possible for the profiled spring 33 to be supported on a part of the gear casing, e.g. a casing cover. In this case, it cannot be forced out of its position on the pressure plate 17, even if increased forces are acting on the cold-start plate 31, which would otherwise push the profiled spring 33 away from the cold-start plate 31 via the spring tongues 49.

Depending on the available installation space, e.g. in the gear casing, it is also possible for the profiled spring 33 to have been shifted further in the direction of the pressure plate 17 after installation than is shown in FIG. 3. In this case, the preloading force exerted on the cold-start plate 31 by the spring tongue 49 is increased. Ultimately, corresponding installation conditions have to be taken into account when dimensioning the profiled spring 33 with a view to a desired opening pressure of the cold-start plate 31.

The following is found: on the one hand, the profiled spring 33 has the function of introducing a preload into the cold-start plate 31 in the installed state of the pump 1, as a cold-start plate spring, in order, in particular, to bring about improved starting behavior of the pump 1. On the other hand, it serves to introduce a preload into the cold-start plate 31 during transportation of the pump 1 or, indeed, more generally in the disassembled state thereof, said preload holding the cold-start plate on the pressure plate 17. At the same time, the profiled spring 33 holds itself on the pressure plate 17 and thus serves to prevent the loss of all elements of the cold-start plate assembly, namely the profiled spring 33 itself, the cold-start plate 31 and also the guide pins 45.

Figure 4:
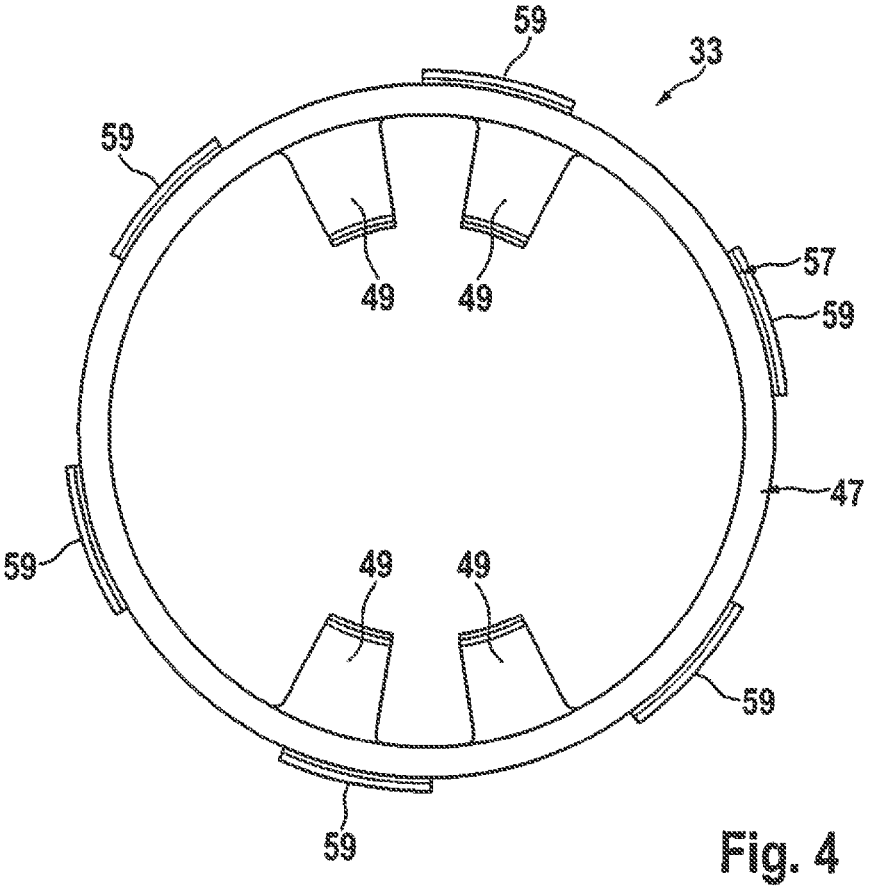
FIG. 4 shows an illustrative embodiment of a profiled spring in plan view.

FIG. 4 shows a modified illustrative embodiment of a profiled spring 33. Elements that are the same and those that have the same function are provided with the same reference signs, and therefore to this extent attention is drawn to the preceding description. The illustrative embodiment shown has an outer ring 47, from which four spring tongues 49 extend in the direction of a cold-start plate (not shown). In another illustrative embodiment, it is possible to provide a different number of spring tongues 49.

In the illustrative embodiment shown, the holding elements are designed as bayonet collars 57 having at least two, in this case six, radial projections 59. These engage in corresponding undercuts in the pressure plate 17 (not shown).

Figure 5:
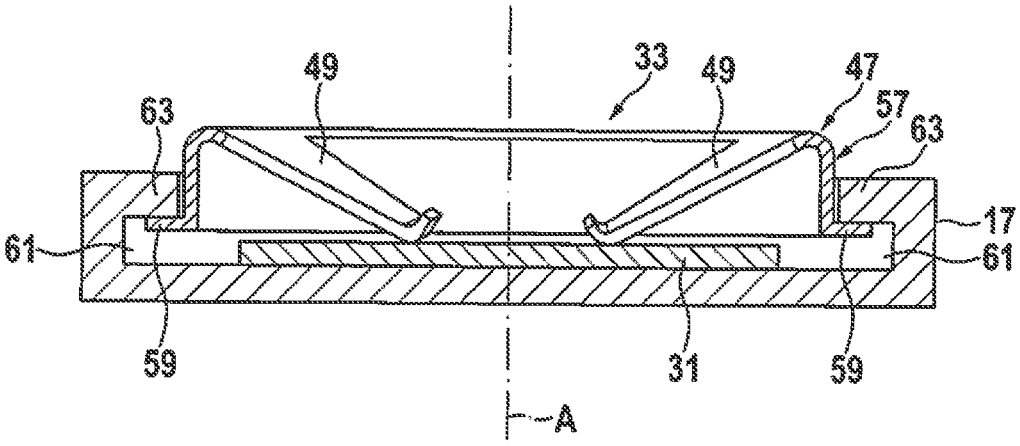
FIG. 5 shows a schematic sectional view of another illustrative embodiment of a profiled spring, which is inserted into a pump.

FIG. 5 shows an illustrative embodiment, similar to FIG. 4, of the profiled spring 33 in a schematic sectional view, wherein the profiled spring 33 is shown schematically as inserted into an indicated pressure plate 17. Adjoining the ring 47 is the bayonet collar 57—as seen in an axial direction—on which the projections 59 are provided. It is possible to provide six projections 59, as shown in FIG. 4. A different number of projections is also possible. In particular, it is envisaged that two projections 59 be provided in one illustrative embodiment.

The pressure plate 17 has undercuts 61, which are at least partially covered by radial projections 63. It is possible for a single undercut 61, which extends over the entire pressure plate 17—as seen in a circumferential direction—to be provided. Arranged between projections 63—as seen in a circumferential direction—there are gaps, through which projections 59 can be introduced into the undercut 61 when the profiled spring 33 is arranged in a first rotational position relative to the pressure plate 17. By pivoting the profiled spring 33 into a second rotational position, projections 59 are arranged in the undercuts 61 in such a way that they engage behind projections 63. The profiled spring 33 is then locked on the pressure plate 17 in the manner of a bayonet joint. In this state, the spring tongues 49 are preferably preloaded against the pressure plate 31, with the result that ultimately projections 59 are also preloaded against the projections 63 of the pressure plate 17 or pressed against them because the profiled spring 33 is supported on the pressure plate 17 via said projections 59. Frictional forces thus arise between projections 59 and projections 63, preventing the profiled spring 33 from accidentally pivoting back into its first rotational position and thus being unlocked.

As already explained in connection with FIG. 3, it is possible for the profiled spring to be shifted in the direction of the cold-start plate 31 during installation of the pump 1 into a gear casing, for example, with the result that projections 59 no longer rest on projections 63 in the installed state. In this case, the preloading force acting on the cold-start plate 31 increases owing to the increased stress of the spring tongues 49.

Overall, it is found that the pump 1 has a profiled spring 33 which is held captive on the pressure plate 17. At the same time, this ensures that the cold-start plate 31 and, where applicable, the guide pins 45 are also held captive on the pressure plate 17. The profiled spring 33 is supported on the pressure plate 17, eliminating the need for any other, complex supporting structures if the pump 1 has no casing or the profiled spring 33 cannot be supported on a pump casing for other reasons. Moreover, the profiled spring 33 introduces a preload into the cold-start plate 31, with the result that, on the one hand, said plate rests reliably and in a defined manner on the pressure plate 17 during transportation and, on the other hand, it can reliably perform its function for improved starting behavior of the pump 1. Particularly when the pump 1 is designed as a cartridge pump, the profiled spring 33 and the cold-start plate 31 are held reliably on the pump 1 both during dispatch or transportation and also during installation of said pump.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

List of Reference Signs

1 pump
3 cam ring
5 aperture
7 rotor
9 aperture
11 inner wall
13 side plate
15 opening

17 pressure plate
19 pressure pin
21 recess
23 head
25 step
27 counterbore
29 hole
31 cold-start plate
33 profiled spring
35 O-ring
37 O-ring
39 under-vane region
41 opening
43 hole
45 guide pin
47 ring
49 spring tongue
51 projection
53 recess
54 delivery element
55 clamping protrusion
57 bayonet collar
59 projection
61 undercut
63 projections
131 main body
143 edge
145 holes
A axis

The invention claimed is:

1. A pump comprising:

a cam ring which has an axial aperture;

a rotor which is received in the axial aperture so as to be rotatable relative to the cam ring, wherein the rotor has radial recesses in which delivery elements are displaceably received as viewed in a radial direction;

a side plate which closes off the axial aperture on a first side;

a pressure plate which closes off the axial aperture on a second side, wherein a pressure region of the pump is fluidically connectable to external surroundings of the pressure plate through the pressure plate;

wherein the pressure region of the pump is fluidly connected to an under-vane region of the delivery elements;

a cold-start plate which is preloaded against the pressure plate by a spring element in such a way that, at least when the pump is stationary, the cold-start plate fluidly disconnects the pressure region of the pump to the external surroundings of the pressure plate;

the spring element being supported on the pressure plate so as to introduce preloading forces onto the cold-start plate;

the spring element being secured on the pressure plate; and the spring element being a profiled spring having an outer ring, at least one spring tongue extending from the outer ring in a direction toward the cold-start plate, and at least two axial projections extending from the outer ring for securing the profiled spring on the pressure plate.

2. The pump as claimed in claim 1, wherein the pump is either a roller pump or vane pump, and wherein the delivery elements are correspondingly rollers or vanes.

3. The pump as claimed in claim 1, wherein the pump does not have a casing.

4. The pump as claimed in claim 1, wherein the pump is a gear pump for installation in a gear casing.

5. The pump as claimed in claim 1, wherein the pump is a cartridge pump.

6. The pump as claimed in claim 1, wherein the axial projections on the profile spring are retained in corresponding axial recesses formed in the pressure plate.

7. The pump as claimed in claim 1, wherein the axial projections are bayonet collars, and wherein the bayonet collars engage in corresponding undercuts in the pressure plate.

8. The pump as claimed in claim 1, wherein the axial projections are radially preloaded and engage in corresponding axial recesses in the pressure plate.

9. The pump as claimed in claim 8, wherein the projections comprise clamping protrusions.

10. The pump as claimed in claim 1, wherein the axial projections extend into and are retained in a circular groove formed in the pressure plate.

11. A pump comprising:

a cam ring having an aperture;

a rotor disposed within the aperture for rotation relative to the cam ring, the rotor having radial recesses in which radially moveable delivery elements are disposed;

a side plate closing off a first side of the aperture;

a pressure plate closing off a second side of the aperture, wherein a pressure region of the pump is fluidically connectable to external surroundings of the pressure plate through the pressure plate;

the pressure region of the pump fluidically connected to an under-vane region of the delivery elements;

a cold-start plate;

a profiled spring applying a pre load against the pressure plate such that, at least when the pump is stationary, the cold-start plate is biased against the pressure plate and fluidically disconnects the pressure region of the pump from the external surroundings through the pressure plate, the profiled spring including an outer ring, at least one pair of spring tongues extending from the outer ring and engaging the cold-start plate, and an axial projection extending from the outer ring for securing the profiled spring to the pressure plate.

12. A pump comprising:

a cam ring having an aperture extending along an axis between a first side and a second side;

a rotor disposed within the aperture for rotation about the axis relative to the cam ring, the rotor having radial recesses in which radially moveable delivery elements are disposed;

a side plate closing off the first side of the aperture;

a pressure plate closing off the second side of the aperture;

a cold-start plate overlying the pressure plate;

a profiled spring applying a pre load against the pressure plate such that, at least when the pump is stationary, the cold-start plate is biased against the pressure plate to fluidically disconnect a pressure region of the pump from external surroundings of the pressure plate, and when a delivery pressure of the pump in the pressure region increases beyond a limiting pressure, the cold-start plate is raised from the pressure plate to fluidically connect the pressure region of the pump to the external surroundings; and the profiled spring including an outer ring, at least one pair of spring tongues extending from the outer ring and engaging the cold-start plate, and an axial projection extending from the outer ring for securing the profiled spring to the pressure plate.

* * * * *